US005562131A

United States Patent [19]

Drawbaugh

[11] Patent Number: 5,562,131

[45] Date of Patent: Oct. 8, 1996

[54] DRIP-FREE OIL DRAIN PAN

[76] Inventor: Thomas W. Drawbaugh, 9201 Colonsay Way, Sacramento, Calif. 95829

[21] Appl. No.: 497,868

[22] Filed: Jul. 3, 1995

[51] Int. Cl.[6] ..... B65B 1/04

[52] U.S. Cl. ..... 141/98; 141/378; 184/106; 184/1.5; 220/573

[58] Field of Search ..... 184/1.5, 106; 141/98, 141/378, 369; 220/573, 571, 738, 737, DIG. 6

[56] References Cited

U.S. PATENT DOCUMENTS

| | | | |
|---|---|---|---|
| 3,410,438 | 11/1968 | Bartz | 184/106 |
| 4,673,081 | 6/1987 | Habig et al. | 184/106 |
| 4,802,599 | 2/1989 | Hill | 220/573 |
| 5,489,042 | 2/1996 | Ewald | 220/573 |

*Primary Examiner*—Thomas E. Denion

[57] ABSTRACT

A drip-free oil drain pan comprising a tray is disclosed. The pan has a lower imperforate plate with an enlarged first section of a generally circular configuration and has co-extensive therewith, in a common plane, a second section in a generally circular configuration. The first and second sections are coupled together at a common throat area of reduced size. The drain pan further comprises an upstanding side wall for the plate including a first side wall extending upwardly from around the majority of the first section of the planar plate except in the reduced throat area. Also provided is a second side wall extending upwardly from around the majority of the second section of the planar plate except in the reduced throat area and formed as an extension of the first side wall. The second side wall is formed with planar steps having a greater diameter at varying elevations above the planar surface for accommodating and supporting oil filters of different sizes with a channel formed in the second side wall at a location diametrically opposed from the reduced throat area to define a curved chute for the movement of oil from the filter onto the entire upper surface of the imperforate plate.

4 Claims, 4 Drawing Sheets

DRIP-FREE OIL DRAIN PAN

BACKGROUND OF THE INVENTION

1. Field of the Invention

The present invention relates to a new and improved drip-free oil drain pan and, more particularly, pertains to draining oil in a convenient, simplified manner to minimize the spillage of the oil.

2. Description of the Prior Art

The use of containers of various designs and configurations for receiving spent oil and other liquids is known in the prior art. More specifically, containers of various designs and configurations for receiving spent oil and other liquids heretofore devised and utilized for the purpose of facilitating the draining of spent oil from filters by a wide variety of methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for draining oil in a convenient, simplified manner to minimize the spillage of the oil. By way of example, U.S. Pat. No. 4,592,448 to Morris discloses an oil pan drain receptacle.

U.S. Pat. No. 4,673,081 to Habig et al. discloses a waste oil drain collector and storage container kit.

U.S. Pat. Nos. 5,082,035 and 5,301,724 to Maxwell disclose oil collecting and dispensing apparatuses.

Lastly, U.S. Pat. No. Des. 317,117 to Pollacco discloses an oil drain pan.

In this respect, the drip-free oil drain pan according to the present invention substantially departs from the conventional concepts and designs of the prior art, and in doing so provides an apparatus primarily developed for the purpose of draining oil in a convenient, simplified manner to minimize the spillage of the oil.

Therefore, it can be appreciated that there exists a continuing need for a new and improved drip-free oil drain pan which can be used for draining oil in a convenient, simplified manner to minimize the spillage of the oil. In this regard, the present invention substantially fulfills this need.

SUMMARY OF THE INVENTION

In view of the foregoing disadvantages inherent in the known types of containers of various designs and configurations for receiving spent oil and other liquids now present in the prior art, the present invention provides an improved drip-free oil drain pan. As such, the general purpose of the present invention, which will be described subsequently in greater detail, is to provide a new and improved drip-free oil drain pan and methods which have all the advantages of the prior art and none of the disadvantages.

To attain this, the present invention essentially comprises a new and improved drip-free oil drain pan comprising, in combination, a tray having a lower imperforate plate, the lower imperforate plate having an enlarged first major section of a generally circular configuration and having co-extensive therewith, in a common plane a second minor section in a generally circular configuration, the first and second sections being coupled together at a common throat area of reduced size; an upstanding side wall for the plate, the upstanding side wall including a first major side wall extending upwardly from around the majority of the first major section of the planar plate except in the reduced throat area and a second minor side wall extending upwardly from around the majority of the second minor section of the planar plate except in the reduced throat area and formed as an extension of the first side wall; the second side wall being formed with horizontal planar steps having a greater diameter at varying elevations above the planar surface for accommodating and supporting oil filters of different sizes with a channel formed in the second side wall at a location diametrically opposed from the reduced throat area to define a curved chute for the movement of oil from the filter onto the entire upper surface of the imperforate plate; a spout formed in the exterior surface of the first side wall at a location diametrically opposed from the reduced throat area, the spout having a threaded exterior edge; and a cap receivable on the spout to preclude oil from inadvertently spilling from the region above the imperforate plate and between the side walls, the cap adapted to be removed from the spout to allow the convenient removal of oil from the region above the imperforate plate and between the side walls.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drip-free oil drain pan which has all the advantages of the prior art containers of various designs and configurations for receiving spent oil and other liquids and none of the disadvantages.

It is another object of the present invention to provide a new and improved drip-free oil drain pan which may be easily and efficiently manufactured and marketed.

It is a further object of the present invention to provide a new and improved drip-free oil drain pan which is of a durable and reliable construction.

An even further object of the present invention is to provide a new and improved drip-free oil drain pan which is susceptible of a low cost of manufacture with regard to both materials and labor, and which accordingly is then susceptible of low prices of sale to the consuming public, thereby making such containers of various designs and configurations for receiving spent oil and other liquids economically available to the buying public.

Still yet another object of the present invention is to provide a new and improved drip-free oil drain pan which provides in the apparatuses and methods of the prior art some of the advantages thereof, while simultaneously overcoming some of the disadvantages normally associated therewith.

Even still another object of the present invention is to drain oil in a convenient, simplified manner to minimize the spillage of the oil.

Lastly, it is an object of the present invention to provide a drip-free oil drain pan comprising a tray. The pan has a lower imperforate plate with an enlarged first section of a generally circular configuration and has co-extensive therewith, in a common plane, a second section in a generally circular configuration. The first and second sections are coupled together at a common throat area of reduced size. The drain pan further comprises an upstanding side wall for the plate including a first side wall extending upwardly from around the majority of the first section of the planar plate except in the reduced throat area. Also provided is a second side wall extending upwardly from around the majority of the second section of the planar plate except in the reduced throat area and formed as an extension of the first side wall. The second side wall is formed with planar steps having a greater diameter at varying elevations above the planar surface for accommodating and supporting oil filters of different sizes with a channel formed in the second side wall at a location diametrically opposed from the reduced throat area to define a curved chute for the movement of oil from the filter onto the entire upper surface of the imperforate plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
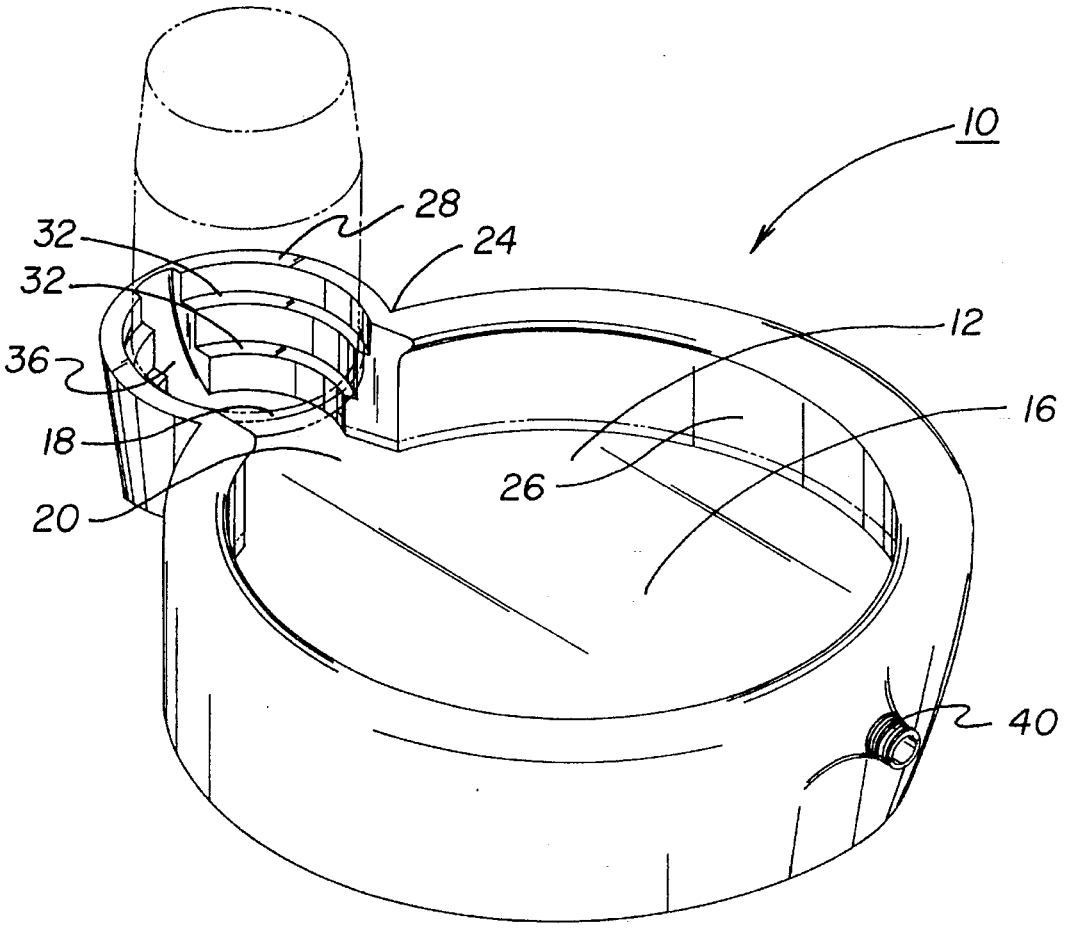
FIG. 1 is a perspective illustration of the preferred embodiment of the new and improved drip-free oil drain pan constructed in accordance with the principles of the present invention.
Figure 2:
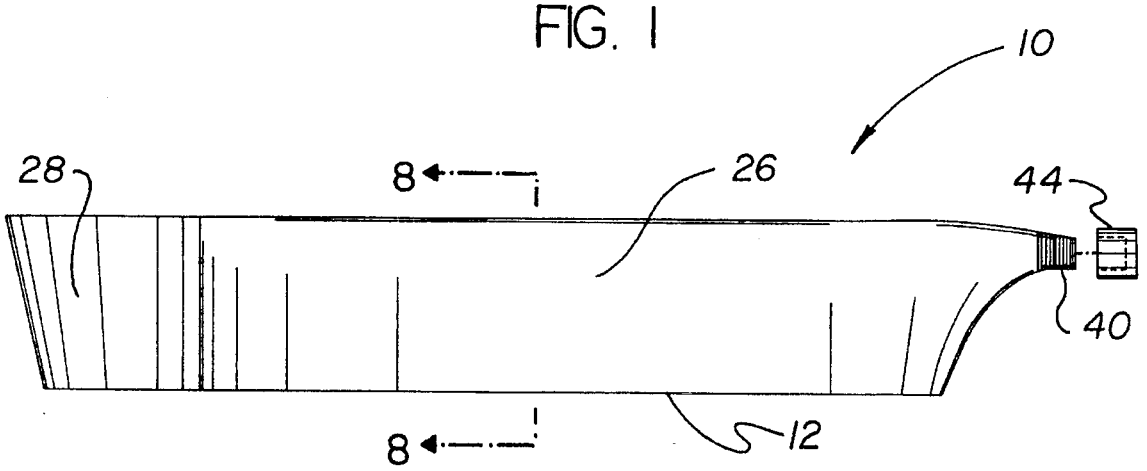
FIG. 2 is a side elevational view of the device shown in FIG. 1.
Figure 4:
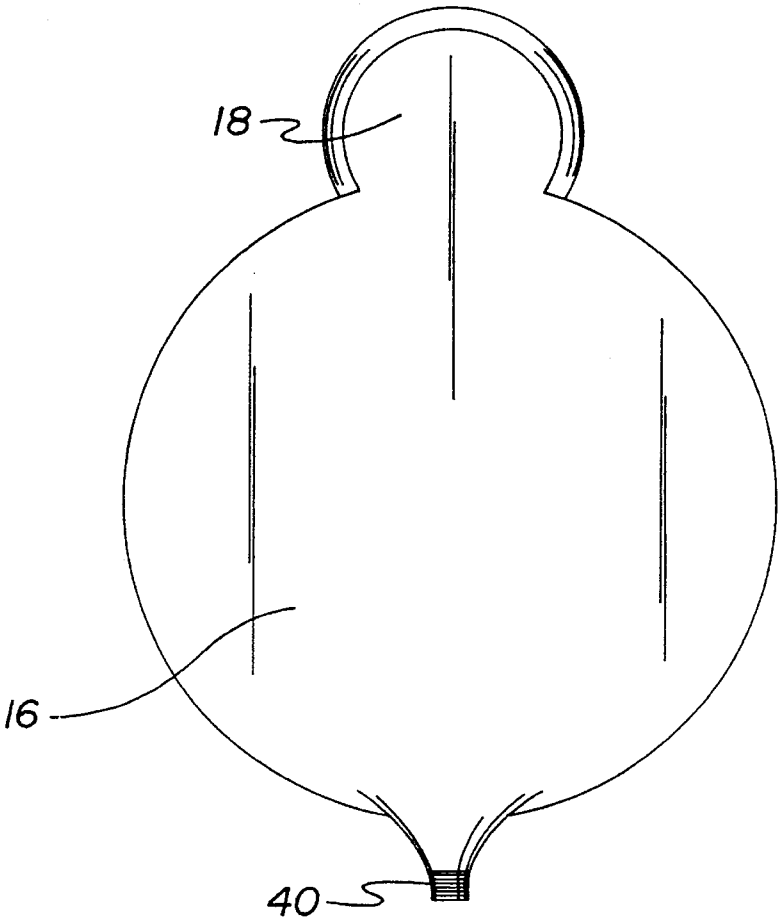
FIG. 4 is a bottom plan view of the device shown in the prior Figures.
Figure 3:
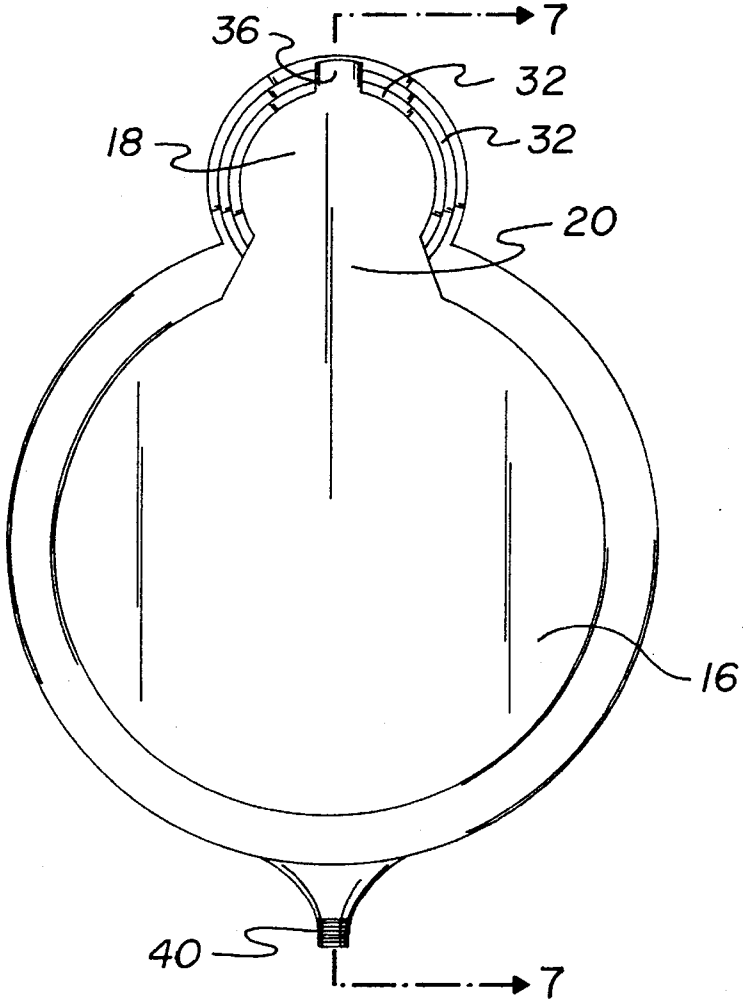
FIG. 3 is a top plan view of the apparatus shown in the prior Figures.
Figure 5:
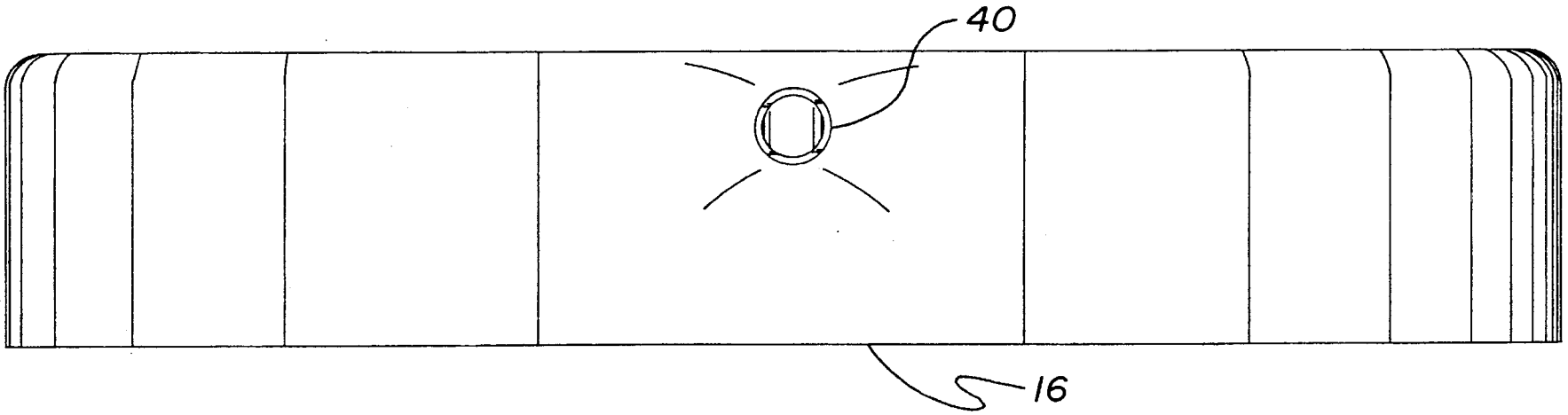
FIG. 5 is a front elevational view of the device shown in the prior Figures.
Figure 6:
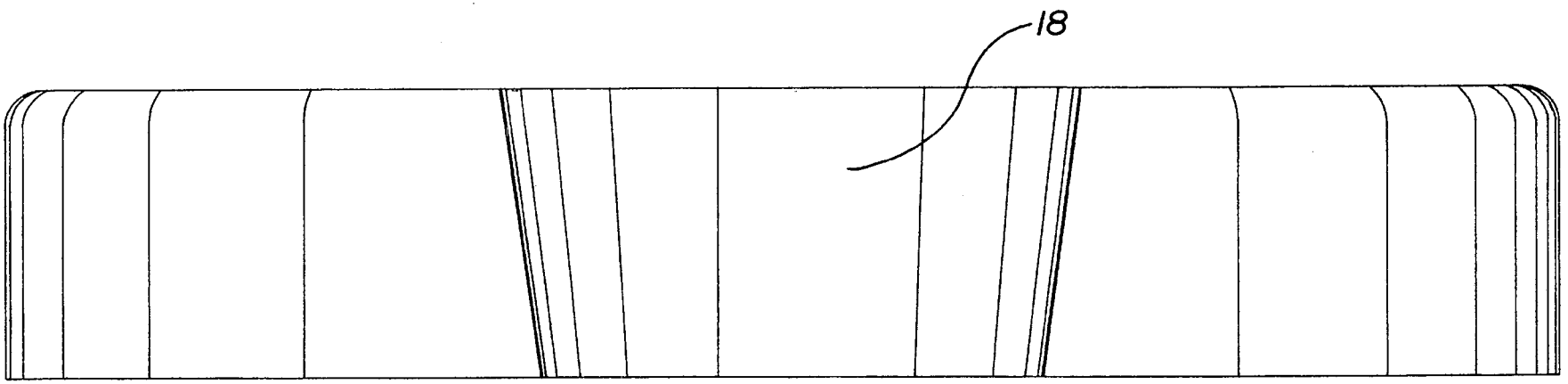
FIG. 6 is a rear elevational view of the device shown in the prior Figures.
Figure 7:
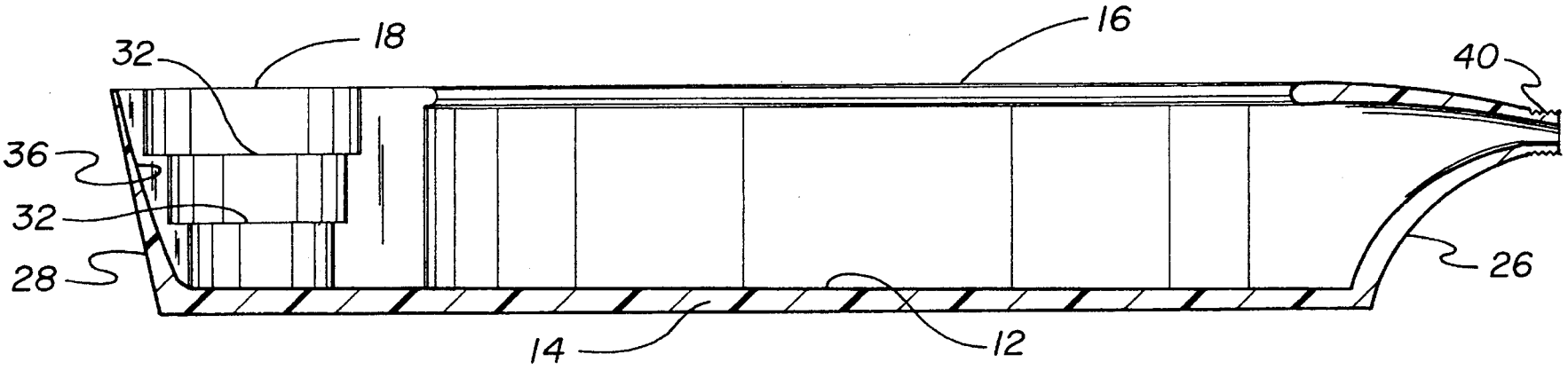
FIG. 7 is a cross-sectional view taken along line 7—7 of FIG. 3.
Figure 8:
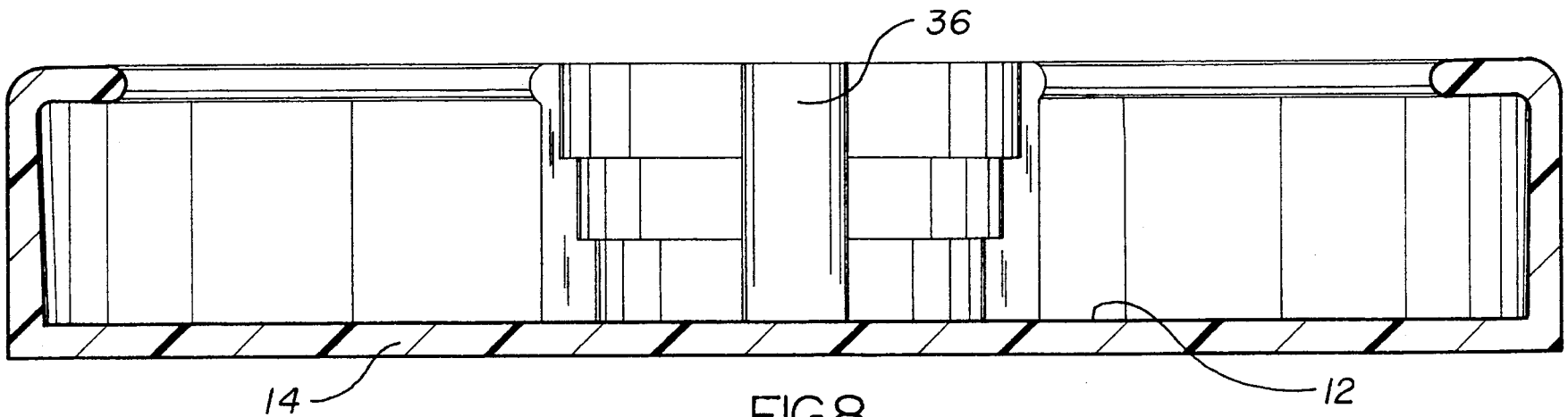
FIG. 8 is a cross-sectional view taken along line 8—8 of FIG. 2. The same reference numerals refer to the same parts throughout the various Figures.

With reference now to the drawings, and in particular to FIG. 1 thereof, the preferred embodiment of the new and improved drip-free oil drain pan embodying the principles and concepts of the present invention and generally designated by the reference numeral 10 will be described.

The present invention, the new and improved drip-free oil drain pan is a system 10 comprised of a plurality of components. In their broadest context, the components include a tray, side walls, a spout and a cap. Each of the individual components is specifically configured and correlated one with respect to the other so as to attain the desired objectives.

More specifically, the oil drain pan 10 of the present invention has as its major component a tray 12. Such tray has a lower imperforate plate 14. Such lower imperforate plate has an enlarged first major section 16 which is of a generally circular configuration. Co-extensive with the first major section in a common plane therewith is a second minor section 18. Such minor section is also in a generally circular configuration. The first and second sections are coupled together at a common throat area 20 of a reduced size.

Integrally formed with respect to the imperforate plate is an upstanding side wall 24 for the plate. Such upstanding wall includes a first major side wall 26 extending upwardly from the majority of the first major section of the planar plate. It does not extend upwardly in the reduced throat area. The side wall 24 also includes a second minor side wall 28 extending upwardly from around the majority of the second minor section of the planar plate except in the reduced throat area. The second minor side wall is formed as an extension of the first side wall.

The second side wall is formed with horizontal planar steps 32. The steps have a greater diameter at varying elevations above the planar surface. This is to accommodate and support oil filters 34 of different sizes adapted to be drained through the pan 10. At a central extent of the steps is formed a channel 36. Such is formed in the second wall at a location diametrically opposed from the reduced throat area. The channel defines a curved chute for the movement of oil from the filter into the entire upper surface of the imperforate plate.

Lastly provided is a spout 40. The spout is formed on the exterior surface of the first side wall. It is at a location diametrically opposed from the reduced throat area. The spout has a threaded exterior edge.

In association with the spout is a threaded cap 44. Such cap is receivable on the spout 40 and functions to preclude oil from inadvertently spilling from the region above the imperforate plate and between the side walls. The cap is adapted to be removed from the spout to allow for the convenient removal of oil from the region above the imperforate plate and between the side walls.

The present invention comprises a drain pan for automotive oil that has both a place to put an oil filter to drain, and a covered spout so the oil can be easily poured into another container for disposal.

It is fabricated from plastic in a shallow circular shape with an integral oil filter drain area on one side and a molded spout opposite it. Formed in concentric circles of increasing diameters, the filter drain supports almost any standard size filter, and has a deep recess line at the center so the oil can drain completely. The drain spout is covered by the body of the pan like a watering can, and should make spills and other accidents far less likely. Curved slightly inward, the side lip helps to keep the oil within the pan's confines. The vertical sides are raised and contoured to enable the user to grab onto something substantial while pouring.

During operation and use, the pan is simply positioned under the drain plug of the automobile as the oil drains. When the filter is removed, it is set on its dedicated drain area. The oil can then be easily poured into a safe container for proper disposal at an area reclamation center.

This drain pan makes the task of changing the oil in the family car less demanding. It helps to prevent spills, and even aids in draining the filter completely. Other designs utilizing posts to support the filter may block the oil and cause residual oil to leak. Anyone who changes oil should appreciate the present invention's clear advantages.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved drip-free oil drain pan comprising, in combination:

a tray having a lower imperforate plate, the lower imperforate plate having an enlarged first major section of a generally circular configuration and having co-extensive therewith, in a common plane a second minor section in a generally circular configuration, the first and second sections being coupled together at a common throat area of reduced size;

an upstanding side wall for the plate, the upstanding side wall including a first major side wall extending upwardly from around the majority of the first major section of the planar plate except in the reduced throat area and a second minor side wall extending upwardly from around the majority of the second minor section of the planar plate except in the reduced throat area and formed as an extension of the first side wall;

the second side wall being formed with horizontal planar steps having a greater diameter at varying elevations above the planar surface for accommodating and supporting oil filters of different sizes with a channel formed in the second side wall at a location diametrically opposed from the reduced throat area to define a curved chute for the movement of oil from the filter onto the entire upper surface of the imperforate plate;

a spout formed in the exterior surface of the first side wall at a location diametrically opposed from the reduced throat area, the spout having a threaded exterior edge; and a cap receivable on the spout to preclude oil from inadvertently spilling from the region above the imperforate plate and between the side walls, the cap adapted to be removed from the spout to allow the convenient removal of oil from the region above the imperforate plate and between the side walls.

2. A drip-free oil drain pan comprising:

a tray having a lower imperforate plate, the lower plate having an enlarged first section of a generally circular configuration and having co-extensive therewith, in a common plane, a second section in a generally circular configuration, the first and second sections being coupled together at a common throat area of reduced size;

an upstanding side wall for the plate, the upstanding side wall including a first side wall extending upwardly from around the majority of the first section of the planar plate except in the reduced throat area and a second side wall extending upwardly from around the majority of the second section of the planar plate except in the reduced throat area and formed as an extension of the first side wall; and the second side wall being formed with planar steps having a greater diameter at varying elevations above the planar surface for accommodating and supporting oil filters of different sizes with a channel formed in the second side wall at a location diametrically opposed from the reduced throat area to define a curved chute for the movement of oil from the filter onto the entire upper surface of the imperforate plate.

3. The apparatus as set forth in claim 2 and further including:

a spout formed in the exterior surface of the first side wall at a location diametrically opposed from the reduced throat area.

4. The apparatus as set forth in claim 3 and further including:

a cap receivable on the spout to preclude oil from inadvertently spilling from the region above the imperforate plate and between the side walls, the cap adapted to be removed from the spout to allow the convenient removal of oil from the region above the imperforate plate and between the side walls.

* * * * *